United States Patent [19]

Greene et al.

[11] Patent Number: 4,527,366

[45] Date of Patent: Jul. 9, 1985

[54] CURVILINEAR STAIRWAY CONSTRUCTIONS

[75] Inventors: Paul S. Greene; David A. Greene, both of Hoopeston, Ill.

[73] Assignee: Greene Welding and Hardware, Inc., East Lynn, Ill.

[21] Appl. No.: 332,969

[22] Filed: Dec. 21, 1981

[51] Int. Cl.[3] ..... E04F 11/00; E06C 9/00

[52] U.S. Cl. ..... 52/184; 52/182; 52/187; 182/83

[58] Field of Search ..... 52/182–184, 52/187, 191; 182/83, 93, 106, 178, 194

[56] References Cited

U.S. PATENT DOCUMENTS

| | | | |
|---|---|---|---|
| 705,794 | 7/1902 | Snider | 52/187 |
| 750,998 | 2/1904 | Ohnstrand | 52/187 |
| 829,107 | 8/1906 | Grossman | 52/188 |
| 853,134 | 5/1907 | Steiber | 52/182 |
| 1,229,482 | 6/1917 | LeClair | 52/187 |
| 1,412,788 | 4/1922 | Lehman | 52/184 X |
| 1,565,580 | 12/1925 | Manton | 52/188 |
| 3,902,948 | 9/1975 | Morros | 52/187 X |
| 4,004,384 | 1/1977 | Hood | 52/188 |
| 4,118,816 | 10/1978 | Mittag | 182/106 X |
| 4,143,740 | 3/1979 | Matthews | 52/187 X |
| 4,355,700 | 10/1982 | Matthews et al. | 52/187 X |
| 4,419,851 | 12/1983 | Kruger | 52/184 |

FOREIGN PATENT DOCUMENTS

| | | | |
|---|---|---|---|
| 804041 | 4/1951 | Fed. Rep. of Germany | 52/191 |
| 2390564 | 1/1979 | France | 52/182 |

*Primary Examiner*—Alfred C. Perham

*Attorney, Agent, or Firm*—Lockwood, Alex, FitzGibbon & Cummings

[57] ABSTRACT

A curvilinear stairway construction for mounting to a curvilinear wall includes a plurality of stringers which are mountable one above the other and which are normally straight, but bend such that the curvature of the stringers is substantially concentric to the curvature of the wall when the stringers are mounted by the steps to the wall. Reinforcing means extend in opposite directions from the plane of the stringers adjacent the longitudinal edges of the stringers. The ends of the stringers contain a plurality of apertures for directly attaching the stringer ends together and the apertures and reinforcing means are positioned so as to allow horizontal movement of the stringer ends relative to each other to adjust for differing degrees of curvature of the wall.

21 Claims, 11 Drawing Figures

FIG. 5
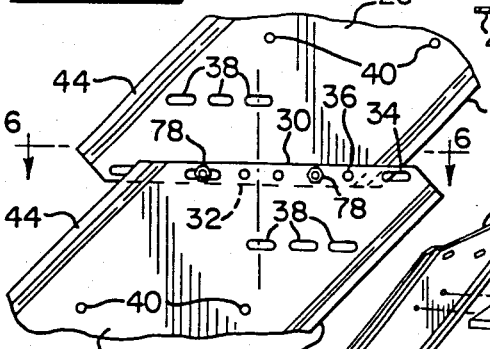
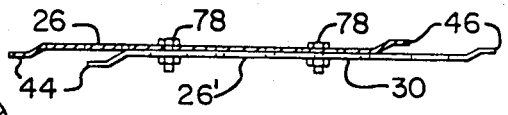
FIG. 6
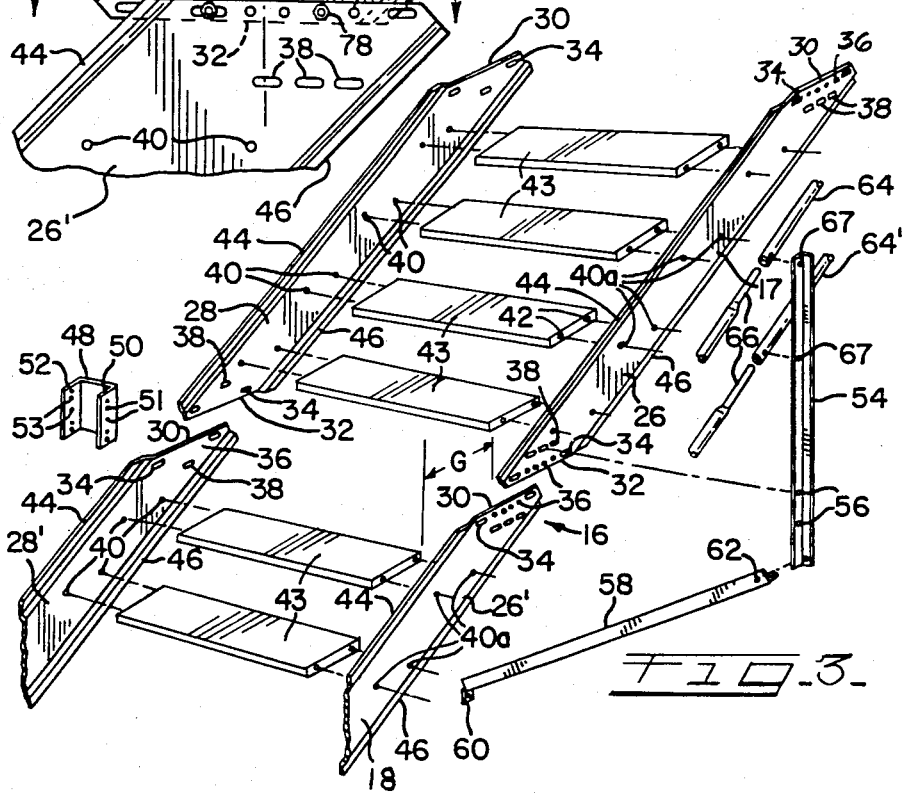
FIG. 3
FIG. 8
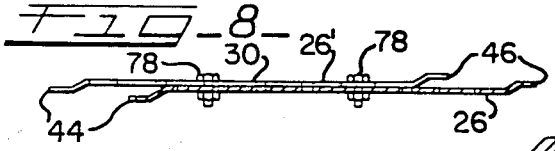
FIG. 7
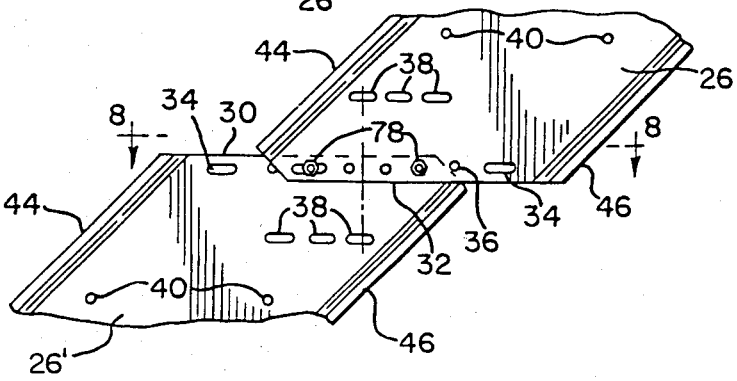

CURVILINEAR STAIRWAY CONSTRUCTIONS

BACKGROUND AND SUMMARY OF THE INVENTION

The present invention relates to stairway constructions and, more particularly, to prefabricated curvilinear stairway constructions adapted to be mounted to curvilinear walls having differing degrees of curvature.

The fitting and assembly of stairways to curvilinear walls presents problems which are unique and do not exist where the stairways are to be mounted to flat planar wall surfaces. One such problem is the difficulty of mounting prefabricated stairway units on such curvilinear walls. This is because prefabricated constructions have components which are usually of fixed, predetermined dimensions. However, structures having curvilinear walls, such as the walls on cylindrical tanks and grain bins, frequently vary over wide ranges of curvature between given installations. For example, grain bins may have diameters of curvature of anywhere between 15 to 105 feet or more, Conversely, the planarity of flat wall surfaces is constant between different installations and, therefore, are readily adapted to accommodate prefabricated constructions having components of predetermined dimensions.

A few proposals have been made in the past for prefabricated stairway constructions which are adapted to be mounted to structures having curvilinear walls. One such prefabricated construction is shown in U.S. Pat. No. 4,143,740. In that construction, a plurality of modular stairway units of predetermined length are provided which have substantially straight side stringers and slotted connector plates attach consecutive ones of the stringers of the respective units together as the stair is assembled. In such construction, the individual stringers remain substantially straight after assembly. As a result, a gap of varying size, depending upon the degree of curvature of the wall, is present between the outside stringers. The slotted connector plates are provided to bridge this gap so that the stringers of the respective modular units may be attached together. Thus, in essence, each of the stairway units in the construction disclosed in U.S. Pat. No. 4,143,740 remains substantially linear in plan view and when the units are connected together and mounted to the curvilinear wall, they form a polygonal outline, in plan, each of the modular unit segments forming a straight segment of the polygon as the stair rises over the height of the structure.

Such prior prefabricated stairway construction has several disadvantages. One disadvantage is that assembly is complicated by the presence of substantial numbers of parts, such as the additional connector plates and bolts which are needed to bridge the gap between the adjacent stringers. Another disadvantage is the gap itself which is formed in such straight segment constructions. This gap increasingly varies in size from the end of the steps nearer the wall to the outer ends which are spaced from the wall. This gap may be of substantial size where the aforementioned prior stair construction is to be mounted to a wall having a high degree of curvature, i.e. a short diameter of curvature. The varying size of this gap from inside to outside of the stair and its maximum size itself may present a safety hazard for personnel using the stairs.

In order to overcome this gap problem prefabricated stair constructions have been proposed in which the stair assembly more closely approximates the curvilinearity of the wall to avoid the polygonal nature of the stairway construction shown in the aforementioned patent and, thereby, reduce the gap existing between the stairs. However, such constructions are substantially more difficult to assemble to the wall because they have a substantially greater number of pieces and they usually require the simultaneous alignment of a large number of pieces before the pieces can be bolted or otherwise fixed together.

The present invention has the purpose of overcoming these several disadvantages in the prior curvilinear stairway constructions. The stairway constructions incorporating the principles of the present invention may be formed of elements which are all straight during and following manufacture, but which may be bent during assembly and mounting to the wall to be substantially concentric to the curvature of the wall to which they are mounted. Thus, because all of the elements of the stairway construction of the present invention are initially straight, they are easy to manufacture, store, ship to the site of assembly, and to handle during assembly. The stairway constructions incorporating the principles of the present invention, even though initially formed of all straight elements, are capable of substantially reducing the gap which may be present between the steps of the stairway upon assembly of the stairway to walls having a high degree of curvature. Moreover, the constructions of the present invention may be prefabricated, but are readily adapted to fit curvilinear walls even though the diameter of curvature of these walls may vary over a wide range without the need to provide parts especially dimensioned for each given diameter of curvature. The stairway constructions incorporating the principles of the present invention may be assembled to rise either in the right of left direction also without the need to provide parts unique to either of those directions, and are capable of fitting standard structures, such as grain bins, such that the stairway construction of the present invention may be mounted to preexisting bolt holes and using preexisting bolts in the structure without the need to provide additional drilling operations during the course of assembly of the stairway construction. The stairway constructions incorporating the principles of the present invention substantially minimize the number of pieces in the assembly which must be put together, the number of bolt or other fastening means which must be provided, the steps involved in attaching the several pieces together, and the number of elements which must be simultaneously aligned with each other at any given time during the course of assembly. Finally, elements of the stairway construction incorporating the principles of the present invention may be readily reinforced to minimize the weight and thickness of materials used to form these elements and, yet, are readily capable of being firmly assembled together and of easy and rapid adjustment to accommodate a wide range of differing degrees of wall curvature.

In one principal aspect of the present invention, a curvilinear stairway construction for mounting to a curvilinear wall includes first and second stringer means which are elongate members mountable one above the other and which, when unmounted, are substantially straight over their length. Step means includes inner and outer ends and first mounting means mounts the outer ends of at least one of the step means to each of the first and second stringer means at a location spaced from the ends of the stringer means. Second mounting means mounts the inner ends of the step means to the curvilinear wall. The step means cause the first and second stringer means to bend substantially uniformly over their length such that the curvature of the stringer means is substantially concentric to the curvilinear wall when the step means are mounted to the stringer means and to the curvilinear wall, respectively, by the first and second mounting means. Third mounting means mounts the upper end of the first stringer means directly to the lower end of the second stringer means.

In another principal aspect of the present invention, the aforementioned stairway construction includes a plurality of spaced apertures in the upper and lower ends of the first and second stringer means which may be selectively aligned with each other to allow adjustable mounting of the stringer means to each other to adjust for varying degrees of curvature of the curvilinear wall.

In still another aspect of the present invention, reinforcing means are located adjacent the longitudinal edges of the first and second stringer means to reinforce the construction.

These and other objects, features and advantages of the present invention will become readily understood upon a consideration of the following detailed description.

BRIEF DESCRIPTION OF THE DRAWINGS

In the course of this description, the drawings will frequently be referred to in which:

FIG. 3 is an exploded view of the top stairway unit and a partially broken lower unit of the stairway construction as shown in FIG. 2, but prior to assembly and mounting;

FIG. 5 is a broken side elevational view showing the adjustment of two adjacent stringers of the stairway construction of the aforementioned embodiment of the present invention where the curvilinear wall to which the construction is mounted is of larger diameter and lesser degree of curvature than the standard curvature;

FIG. 6 is a cross-sectioned plan view of the construction as viewed substantially along line 6—6 of FIG. 5;

FIG. 7 is a broken side elevation view showing the adjustment of two adjacent stringers of the aforementioned embodiment of the present invention where the curvilinear wall to which the construction is mounted is of smaller diameter and greater degree of curvature than the standard for which the stair was designed;

FIG. 8 is a cross-sectioned plan view of the construction as viewed substantially along line 8—8 of FIG. 7.

DESCRIPTION OF THE PREFERRED EMBODIMENTS

Figure 1:
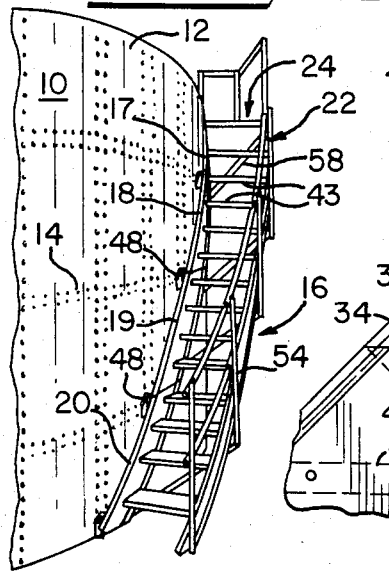
FIG. 1 is a perspective view of a stairway construction incorporating the principles of the present invention as assembled and mounted to a curvilinear wall.
Figure 2:
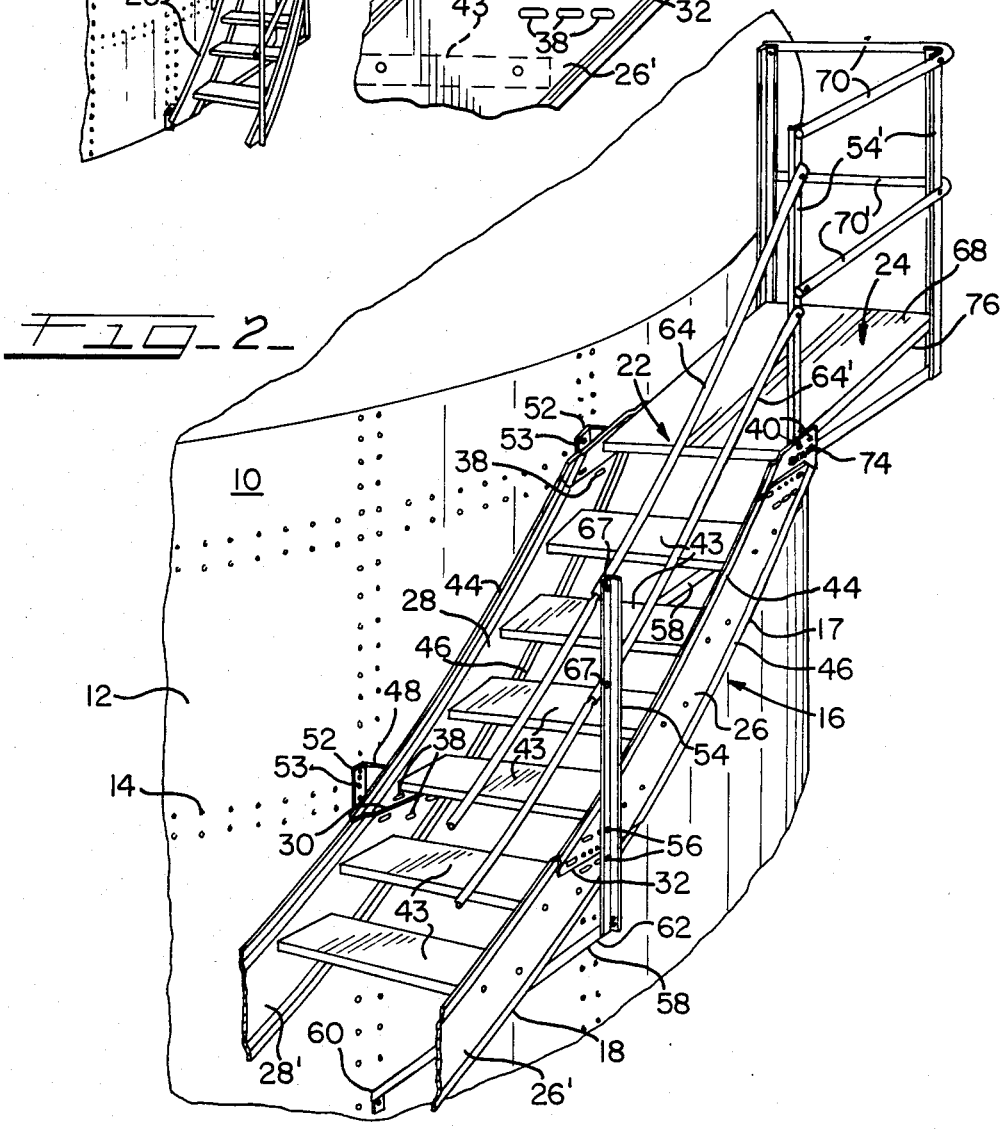
FIG. 2 is an enlarged broken view of one preferred embodiment of stairway construction shown in FIG. 1 which has been assembled and mounted to the curvilinear wall and showing the construction at the top of the wall.

In FIGS. 1 and 2, a preferred embodiment of stair construction in accordance with the principles of the invention is shown assembled and mounted to a curvilinear wall 10. The wall 10 may, for example, be the wall of a cylindrical tank or grain storage bin which is formed of a plurality of sheets or panels 12 which are uniformly attached at spaced locations by bolts or the like 14 at horizontal and/or vertical intervals.

One preferred embodiment of stair construction of the invention includes an inclined stairway portion generally 16, as shown in FIGS. 1 and 2, comprising a plurality of units 17, 18, 19 and 20 as shown in FIG. 1. It will be understood that although only four units 17–20 are shown, the curvilinear stairway construction of the present invention may consist of fewer or greater numbers of units, depending upon the height of the wall to be spanned. The stairway construction also preferably includes a handrail structure generally 22 and may include, at its top terminus, a platform assembly generally 24 as shown in FIGS. 1 and 2.

Figure 4:
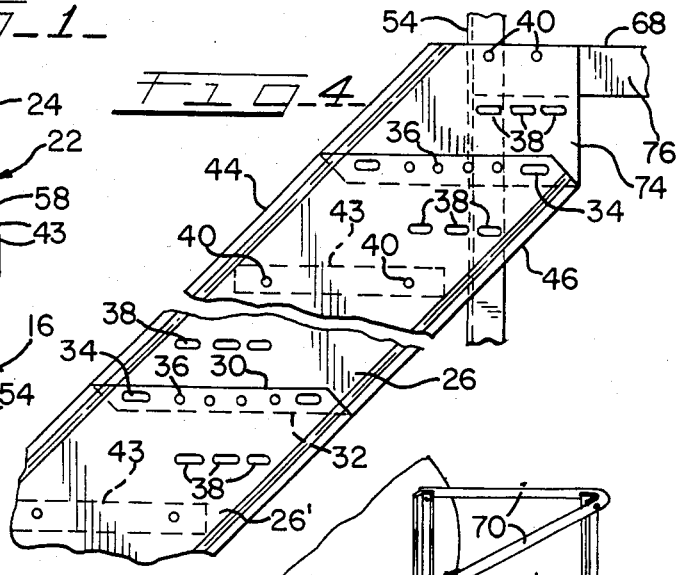
FIG. 4 is a side elevational view of the aforementioned embodiment of stairway construction showing top termination of the construction and in which the stairway has been assembled and mounted to a curvilinear wall having the same diameter to which the stairway construction has been dimensioned as a standard.

Each of the units 17–20 comprises elongate generally planar outer and inner stringers 26, 26' and 28, 28', respectively. Stringers 26 and 26' are identical to each other as are stringers 28 and 28'. The use of the designation "'" hereinafter is simply meant to differentiate a lower stringer from the next adjacent upper stringer, the lower stringer being designated with the numeral carrying the "'" superscript. The outer stringers 26 and 26', however, are preferably a few inches longer than the inner stringers 28 and 28' to compensate for the greater radius of curvature of the outer stringers 26 and 26' and, thereby, the greater circumference which must be spanned by the outer stringers due to the width of the stairway. Stringers 26, 26' and 28, 28' have top and bottom ends 30 and 32, respectively, as shown in FIGS. 2 and 3. These top and bottom ends are preferably cut on an angle relative to the longitudinal axis of stringers 26, 26' and 28, 28' such that when the stringers are assembled as shown in FIGS. 1 and 2, the top ends 30 and bottom ends 32 of the stringers extend substantially horizontally. Although such horizontal cut is preferred, the cut may be at other angles. A plurality of apertures comprising slots 34 and holes 36 are arranged in substantially parallel alignment to the edges 30 and 32 of each of the stringers 26, 26' and slots 34 are similarly arranged at the edges 30 and 32 of each of the inner stringers 28, 28' as shown in FIGS. 3–5. The placement of the slots 34 and holes 36 is such as to allow the stringers to be adjusted horizontally so as to accommodate a variety of wall curvatures between the maximum and minimum curvature to which the stairway construction of the present invention may be mounted as will be described in more detail to follow. Because of this ability to adjust the stringers and to bend them, as shown in FIGS. 1 and 2 and as will be described in more detail to adapt them to a variety of curvatures, the need to provide a variety of stringers of differing lengths to accommodate different curvatures is obviated.

In addition to the slots 34 and holes 36, each of the stringers 26, 26' include a plurality of horizontally spaced slots 38 adjacent the ends 30 and 32. The inner stringers 28, 28' also include at least one such slot 38. Slots 38 are also spaced vertically from the line of holes and slots 34 and 36 as shown in FIGS. 2–5 and 7. Slots 38 are positioned such that for any given position of horizontal adjustment of the stringers to compensate for varying wall curvature, at least one of the slots in one of the stringers will be vertically aligned with one of the slots in the next adjacent stringer. The purpose of slots 38 and the last mentioned alignment will also be described in more detail to follow.

Pairs of apertures and 40*a* are also spaced horizontally, as shown in FIG. 3, at intermediate spaced locations between the ends of the stringers 26, 26' and 28, 28'. Apertures 42 in the outer and inner ends of steps 43 receive bolts (not shown) for mounting those step ends respectively to the outer stringers 26, 26' and inner stringers 28, 28' when the apertures 40 and 40*a* are aligned with step apertures 42. Because the outer stringers 26, 26' are somewhat longer than the inner stringers 28, 28' as previously mentioned the spaced locations of the pairs of apertures 40*a* can be and are at a slightly greater distance from each other than the spacing between the pairs of apertures 40 on the shorter inner stringers 26, 26'. Thus, the apertures 40*a* will readily align with the apertures 42 at the outer ends of the steps 43 as the steps extend radially from the curved inner stringers 28, 28'.

The upper and lower longitudinal edges of each of the stringers 26, 26' and 28, 28' are preferably bent to form elongate reinforcing beads 44 and 46, respectively, along those edges to reinforce the elongate stringers over their lengths. Beads 44 and 46 preferably extend in opposite directions from the planar surfaces of the stringers 26, 26' and 28, 28' to provide for a firm flush overlap and fit of the end of the stringers to each other as shown in FIGS. 5–8, when selective adjustment of the stringers is needed to compensate for variations in curvature of the wall 10. As shown in FIGS. 5 and 6, the lower stringers 26' may be slid horizontally to the right relative to the next upper stringer 26 and is positioned in overlying relationship to the upper stringer 26 with the reinforcing bead 46 extending inward of the stairway to compensate for walls of greater diameter and lesser degrees of curvature. Conversely, in FIGS. 7–8, the lower stringer 26' is slid horizontally to the left relative to the upper stringer 26 and the upper stringer overlies the lower stringer with the upper reinforcing beads 44 extending outward of the stairway and the lower beads 46 extending inward of the stairway. Due to the reversed direction of these reinforcing beads, a configuration is always present which allows the upper and lower stringers 26, 26' to always flushly overlap each other at the ends at which they are attached without interference from the beads.

As shown in FIGS. 1–3, a plurality of U-shaped brackets 48 are also preferably provided for mounting the inner stringers 28 and 28' to the curvilinear wall 10. One of the legs 50 of brackets 48 contains apertures 51 which are spaced to overlie slots 38 in the lower end 32 of stringer 28 and in the upper end 30 of stringer 28', respectively. When the bracket is mounted in overlying relationship to the junction of the upper and lower inner stringers 28 and 28' and bolted through slots 38 and apertures 51 to the joined stringers, the brackets act to further rigidify and strengthen the junction between the two adjacent stringers. The other leg 52 of each of the brackets also contains a plurality of apertures 53 which are spaced so that leg 52 can be mounted to the curvilinear wall 10 with the preexisting bolts 14 of the wall as shown in FIG. 2. The brackets 48 not only serve the function of mounting the stairway construction to the curvlinear wall 10 and rigidifying the junctions of the upper and lower internal inner stringers 28 and 28', but also serve to space the stairway construction slightly from the curvilinear wall 10 and position it out from under the dripline of the curvilinear wall roof to minimize the accumulation of ice, snow and the like. Each of the apertures 51 and 53 are preferably five in number and spaced as shown in FIG. 3 to adapt the brackets for mounting on curvilinear walls formed of corrugated sheet metal wherein the corrugations are of differing magnitude and frequency.

The handrail assembly 22 includes a plurality of vertical posts 54 as shown in FIGS. 1–3. Each of the posts 54 include at least a pair of apertures 56 which are vertically spaced from each other so as to overlie at least one of the slots 38 in the upper outer stringer 26 and one of the slots 38 in the lower stringer 26'. Posts 54 are attached to the upper and lower stringer 26 and 26' after the ends of the stringers have been attached together as previously described. Posts 54 are preferably formed of an angle iron as shown in FIGS. 2 and 3 and preferably span the vertical height of the assembled upper and lower stringers 26 and 26' as shown in FIG. 2, thus, further reinforcing the junctions between the upper and lower stringers. Posts 54 also preferably extend slightly beneath the joined stringers as shown in FIG. 2 to receive a diagonal brace 58 which is attached at one end 60 to the curvilinear wall with one of its preexisting bolts 14 and at its other end 62 to the bottom of the post 54 preferably via two holes 63 as shown in FIG. 3. Brace 58 thereby directly supports the outer side of the stairway construction of the invention.

At least one, and preferably two handrails 64 and 64', are attached to the posts 54 at their respective ends. The handrails 64 and 64' preferably comprise elongate tubes which are necked down at one end 66 as shown in FIG. 3 to fit in a telescopic fashion into the larger lower end of the next adjacent handrail. Because the consecutive tubes telescope at their necked portions 66, the overall lengths of the tubes may be adjusted to compensate for varying degrees of curvature of the wall 10. The necked or reduced portions 66 of the handrails are preferably about one foot long in order to accommodate diameters of curvature of the curvilinear wall 10 ranging from 15 feet to 105 feet. The handrails 64 and 64' may be attached to the posts 54 by a bolt (not shown) which extends through a drilled opening through the end of the handrail tube into which the necked end 66 of the next handrail is inserted, the necked end itself, and a hole 67 in the post 54 as shown in FIGS. 2 and 3.

The top of the stairway construction preferably terminates at platform 24 as shown in FIG. 2. The construction of the platform 24 may include a landing 68 formed of sheet metal or the like, a plurality of vertical posts 54', and a plurality of horizontal handrails 70 and 70'. The stair handrails 64 and 64' are preferably joined to the post 54' at the entrance to the platform by any suitable means, such as screws or bolts.

The stringers 26 and 28 of the uppermost unit 17 are preferably attached to the landing 68 by a short stringer terminating section 74 as shown in FIG. 4. This section 74 preferably merely constitutes the bottom end of one of the stringers which is cut off just above the first set of stair holes 40. Section 74 is attached to the upper end 30 of uppermost stringer 26 in the same manner as the respective stringers are attached to each other as previously described, i.e. alignment of the slots and holes 34 and 36 in section 74 with the slots and holes in the upper end 30 of the uppermost stringer 26. The section 74 in turn, is attached to a downwardly extending flange 76 on the landing 68 by insertion of bolts (not shown) through one or more of the apertures 40 in section 74 and corresponding openings (not shown) in flange 76 and through a hole in the post 54' at the entrance to the platform such that post 54' is sandwiched between the platform and section 74. At least one of the slots 38 in each of the section 74 and stringer 26 are also at least partially vertically aligned to serve as a mounting for the uppermost vertical post 54' at the entrance to the landing 68, as shown in FIG. 4.

As previously discussed, certain of the elements of the above-described construction are preferably dimensioned to a predetermined standard diameter of wall curvature and are then adjusted horizontally in one direction or the other to compensate for diameters of curvature which are larger or smaller than the standard. The elements which need be so dimensioned will be the outer and inner stringers 26, 26' and 28, 28', respectively, and the handrails 64, 64'. In addition, where the wall 10 is formed of sheets 12 which are bolted by bolts 14 to some form of subskeleton at uniformly spaced intervals, such as in a grain bin, these elements are also preferably dimensioned so that their ends overlie or coincide with bolts 14 to minimize drilling of additional mounting holes during assembly of the stairway construction and maximize the use of the already preexisting wall bolts 14.

If, by way of example, a diameter of 30 feet is accepted as the predetermined standard diameter and the rise between adjacent rows of vertically spaced bolts 14 is 44 inches, the length of the outer stringers 26, 26' should be approximately 6 feet and the inner stringer 28, 28' should be about 4 inches shorter. For the same diameter of curvature, but for only a 32-inch rise in bolt 14 spacing, all of the stringers should be about 16 inches shorter than just mentioned. Such lengths are then capable of further compensation by adjustably sliding the stringer ends horizontally relative to each other to compensate for different diameters of curvature of, for example, as little as 15 feet or as much as 105 feet or more, and by bending upon assembly.

Although it is believed from the foregoing description of one of the preferred embodiments of the stairway construction of the present invention that the manner of assembling the stairway construction would be clear to a person skilled in the art, a description of one manner of assembling the previously described stairway construction will follow. It will be understood, however, that one skilled in the art may vary the assembly steps hereinafter set forth without departing from the principles of the invention.

Beginning at the ground, the individual units 20, 19, 18 and 17 are assembled in that order. A pair of the brackets 48 are first mounted to the curvilinear wall 10, one at the bottom of the wall and the next one spaced from the first bracket in both the horizontal and vertical directions at the next course or rise of wall panel bolts 14. The legs 52 of the respective brackets 48 are bolted by bolts 14 through at least two of the openings 53 to the wall 10.

The lower inner stringer 28' is then mounted at its bottom by way of slots 38 and bolts (not shown) to the leg 50 and its holes 51 of bottommost bracket 48. The upper end 30 of the lower stringer 28' is next fixed to the lower end 32 of the next upper stringer 28. Where the curvature of the wall 10 is standard, e.g. the diameter of curvature is 30 feet, the stringer elements 28 and 28' will be in substantially exact longitudinal alignment with each other with their reinforcing beads 44 and 46 coinciding in substantially the same manner as the outer stringers 26 and 26' will be aligned as shown in FIG. 4. Once stringers 28 and 28' are aligned such that their slots 34 are in alignment and overlapping each other, two bolts may be placed through any pair of the aligned openings to attach the inner stringers 28 and 28' together. Once these inner stringers are attached together, they are, in turn, attached to the leg 50 of the next upper bracket 48 by positioning bolts (not shown) through slots 38 in the stringers 28 and 28' and the corresponding apertures 51 in leg 50 of bracket 48.

As the lower stringer 28', which is initially straight, is bolted to the bottom and next upper bracket 48, it will bend in a substantially uniform manner over its length to curve so that it is substantially concentric to the curvature of the curvilinear wall 10, but is spaced from the wall by the width of the bracket 48.

The inner end of the bottommost step 43 is next mounted by bolts (not shown) to the lower inner stringer 28' through apertures 40 in the stringer 28' and apertures 42 in the end of the step 43 as shown in FIG. 3.

Mounting of the bottom step 43 to the lower inner stringer 28' is then followed by mounting the lower outer stringer 26' to the outer end of the bottommost step 43. Mounting is accomplished by inserting bolts (not shown) through the apertures **40*a* in the lower outer stringer 26' and the apertures 42 in the outer ends of the steps 43 as shown in FIG. 3**.

The next steps 43 in unit 20 are next mounted in ascending order first to the inner lower stringer 28' and then the outer lower stringer 26'. Prior to mounting the stringer 26' to the outer ends of the steps 43, the stringer element 26' is substantially straight. However, as the stringer 26' is successively mounted to the outer ends of the steps, it will progressively and uniformly bend to form a curve which is substantially concentric to the curvature of the inner stringer 28' and the curvilinear wall 10.

Thereby it will be seen that the inner ends of the steps 43 will be positioned in spaced relationship to each other along a curve which is substantially concentric to the curvature of the wall 10 to which the stairway construction is to be mounted. This is because they are attached via apertures 40 in the inner stringer 28'. When so attached to the inner stringers 28 and 28', the inner stringers form a support for the inner ends of the steps which supports and fixes them in this spaced relationship. When the inner ends of the steps are supported and fixed in this manner, they will extend substantially radially outwardly from the curved inner support stringers 28, 28' such that their outer ends also will define a curve which is substantially concentric to the curvature of the inner support stringers and the wall 10. Thereby, when the outer stringers 26, 26' are mounted via apertures **40*a*, to the outer ends of the steps 43**, the outer stringers will assume the same curvature.

The initial straightness of the stringers substantially facilitates their manufacture and their ease of shipping and handling during assembly. Yet, the stringers are capable of bending during assembly and do readily bend so that they assume a curvature which is substantially concentric to the curvature of the wall 10.

The upper outer stringer 26 is next attached to the lower outer stringer 26' by overlapping the upper end 30 of the lower stringer 26' with the lower end 32 of the next upper stringer 26. Once the stringer ends are overlapped and their slots 34 and apertures 36 are in alignment and overlying each other, the stringers 26 and 26' are bolted together via these slots and apertures to affix them together. Assuming that the diameter of curvature of wall 10 is the standard for the stairway construction, the upper and lower stringers 26 and 26' will be in exact alignment with each other as shown in FIG. 4 with the reinforcing beads 44 and 46 coinciding.

Once the upper end 30 of the lower stringer 26' and lower end 32 of the upper stringer 26 are attached together, the vertical handrail post 54 may be installed to the outer side of the outer stringer as shown in FIG. 2 by aligning the holes 46 in post 54 with any one of the pair of vertically aligned slots 38 at the bottom of the upper stringer 26 and the top of the lower stringer 26' using bolts (not shown). The diagonal brace 58 may then be installed by attaching its lower end 60 to the preexisting bolts 14 in the wall 10 and upper end 62 by bolting same to the downwardly projecting portion of post 54 via holes 63.

The above procedure for the next upper unit 19 is then repeated until the top of the stair is reached. At this point, the platform is installed as shown in FIG. 2. The handrails 64 and 64' may be the last to be installed or they may be successively installed with each of the units 20–17.

As previously mentioned, the handrails 64 and 64' are installed by inserting the necked portion 66 of a handrail for a lower unit into the larger lower end of the next upward handrail tube. The overall length of the successive handrails may be adjusted to compensate for the actual curvature of the wall 10 by telescoping the necked portion 66 more or less into its next tube. Where the wall curvature is the predetermined standard curvature, the necked portion 66 will extend for approximately half its length into the next tube. If the diameter of curvature is less than the standard, the necked portion 66 will extend into the next tube for more than half its length and where the diameter of curvature is greater than the standard, the necked portion 66 will extend into the next tube for less than half of its length. Once the correct handrail length is reached, a hole is drilled through the bottom of the next upper handrail tube and the necked portion 66 of the next lower tube and a bolt(not shown) is inserted through these holes and holes 67 in the post 54 to mount the handrails 64 and 64' to the post 54.

It is sometimes necessary to adjust for the elevation at which the landing 68 of the platform 24 is installed so that the step up from the landing to the tank or bin top is not too large. Such adjustment may particularly be necessary where the stairway construction of the present invention is being installed to a grain bin and it is desired to mount all of the elements of the stairway construction using the preexisting bolts 14 on the wall of the bin. In such event, it will be seen that the uppermost stringers 26 and 28 terminate either one level below or right at the top of the bin, but not in between these locations. However, it might not be possible, due to roof overhang or for some other reason, to locate the landing 68 directly at the top of the bin and, if it is located where the last of the uppermost stringers end, the step is too large to the bin top, e.g. the step would be 44 inches in the case of a bin having a 44-inch rise.

In such case, one or a combination of elements somewhat different than those previously described may be utilized to terminate the stairway construction at the platform 24. One such element might consist of a stairway unit which is shorter than the others and has fewer stairs. Another element may utilize the terminating section 74 as shown in FIG. 4. Of course, the terminating section 74 could also be used in combination with the aforementioned shorter unit or could be mounted directly to the upper end 30 of the uppermost full length stringers 26 and 28.

Although the foregoing description of the assembly is cast in terms of assembly from the ground up, it will be understood that the direction of assembly may be reversed. For example, the platform 24 may be first installed followed by assembly of the units in descending elevational order.

As previously mentioned, one of the problems presented in a prefabricated stairway construction which is to be mounted to a curvilinear wall is that a wide variety of degrees of curvature will likely be present between different installations. As such, one prefabricated construction must be capable of installation on any one of such wide variety of wall curvatures.

To achieve this result in the present invention, the respective stringers 26, 26' and 28, 28', first of all, are capable of being bent during installation on the job to conform with any of the curvatures which may be encountered, yet they may be manufactured, shipped and handled in the straight state as previously mentioned. Secondly, the stringer lengths may be adjusted on site to vary from the standard curvature to which they were designed, to fit greater and smaller degrees of curvature which are actually encountered at the site to allow them to be directly attached together and not leave a gap.

Where the diameter of curvature is the standard selected for dimensioning for the stairway construction elements, each of the stringers will perfectly align with each other as shown in FIG. 4. In such case, the reinforcing beads 44 and 46 of the consecutive stringers 26 and 26' will also be directly aligned with each other when the stringers are mounted together. Under these standard conditions, it is immaterial which way the reinforcing beads 44 and 46 project from the plane of the stringers, because the beads coincide with and complement each other.

However, if the stairway construction which was designed to a standard 30-foot diameter of curvature is installed on a curvilinear wall having a larger diameter and lesser degree of curvature, for example 105 feet, it is necessary to shift the upper and lower stringers 26 and 26' horizontally relative to each other as shown in FIGS. 5 and 6. This shift will compensate for the lesser stringer length now needed to fit between the preexisting bolts 14. To accommodate such larger diameters of curvature, stringers 26 and 26' are shifted as shown in FIGS. 5 and 6 until other slots and openings 34 and 36 are in alignment, and the lower end 32 of the upper stringer 26 and upper end 30 of the lower stringer 26' are then attached together by bolts 78 as shown in FIGS. 5 and 6.

If the reinforcing beads 44 and 46 both projected from the same sides of the stringers 26 and 26', the beads of the upper stringer would interfere with the aforementioned repositioning of the lower stringer 26' and would prevent the stringer ends from flushly overlying each other. However, because beads 46 extend inwardly of the stair construction toward the steps 43, the bead 46 of the upper stringer 26 does not interfere with the adjustment of the bottom stringer 26' relative to the upper stringer.

Conversely, if the diameter of curvature is substantially smaller than the 30-foot standard diameter, for example 15 feet, the upper and lower stringers 26 and 26' are shift adjusted horizontally in the opposite direction as shown in FIGS. 7 and 8. Now, however, the lower stringer 26' movement to the left would be impaired by the outwardly projecting reinforcing bead 44 on the upper stringer 26. However, because the reinforcing beads 44 and 46 extend in opposite directions from the plane of the stringers, all that need be done is to install the upper stringer 26 on the outside of the lower stringer 26' as shown in FIGS. 7 and 8, rather than vice versa as shown in FIGS. 5 and 6. Thus, interference with the beads 44 and 46 of the respective stringers is avoided and, again, the smaller diameter, greater curvature wall 10 is accommodated.

The stairway construction of the present invention which has thus far been described as being assembled to rise in the right hand direction is just as readily capable of assembly in the left hand direction without the need to substitute any additional elements for the ones described. It is only necessary to turn the stringers 180 degrees, the top reinforceing bead 44 still remaining on top of the stringer and the upper end 30 still remaining the upper end of the stringer.

It will be seen that assembly of the stairway construction of the present invention is facilitated over the constructions of the prior art. The number of bolts and bolting operations necessary to attach adjacent stringers to each other is minimized and the connector plates which span the gap between adjacent stringers have been eliminated. The stringers themselves may be adjusted for all diameters of curvature so that they may be bolted directly together. One stringer unit is capable of carrying one or more steps 43 and the steps are mounted intermediately and independently of the means for mounting the stringers to each other. Thus, the number of parts which must be simultaneously aligned is minimized. For example, it is only necessary to align the slots 34 and apertures 36 of the stringers 26 and 26' to connect the stringers together. Moreover, it is only necessary to align the openings 42 in the steps 43 with the openings 40 in the stringers to mount the steps. The vertical posts 54 may be aligned and mounted to the stringer slots 38 after the stringers have already been attached together and the steps 43 have been attached to the stringers.

Another advantage of the present invention is the substantial reduction in the gap G as shown in FIG. 3 between the outer ends of the steps 43 in adjacent units over the gap which is present in the prior art constructions which consist of a plurality of straight modules or units. This gap reduction is due to the bending of the stringers of the present invention upon assembly so that the individual units 17–20 actually curve to be substantially concentric with the curvilinear wall 10. By way of example, for a diameter of wall curvature of 30 feet and where the stairway construction is dimensioned to such curvature as a standard, the gap G is reduced from about 4.3 inches in the straight unit stairway constructions of the prior art to about 1.5 inches.

Figure 9:
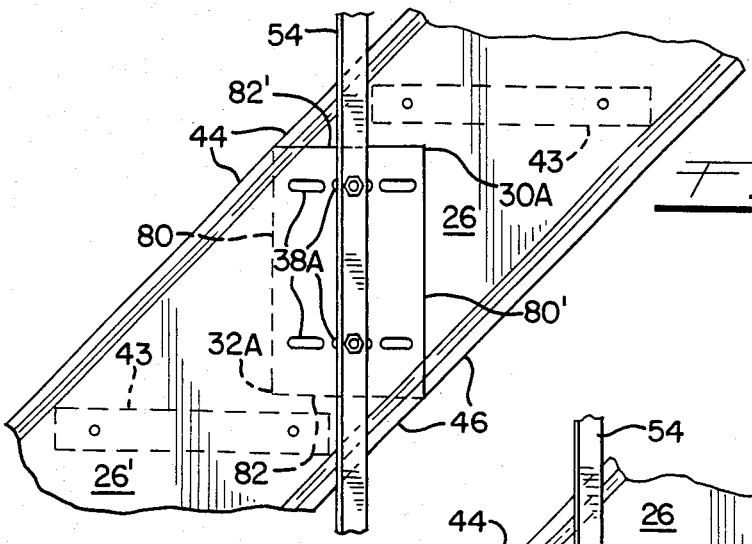
FIGS. 9–11 are broken side elevational views showing the adjustments of a second preferred embodiment of stairway construction according to the principles of the present invention in which the stringers are attached such that they are adjusted to a curvature substantially identical to a selected standard curvature, to a larger diameter and lesser degree of curvature, and to a smaller diameter and greater degree of curvature, respectively.
Figure 10:
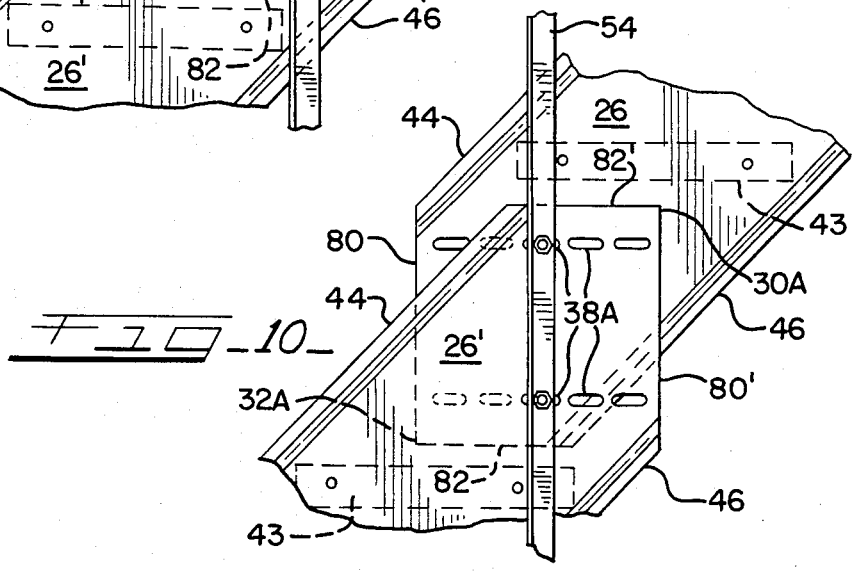
Figure 11:
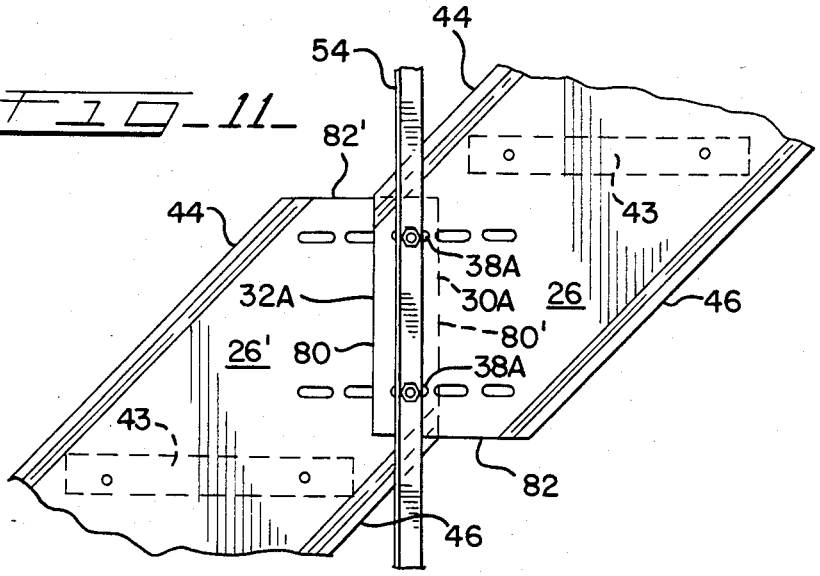

A second preferred embodiment of stairway construction is shown in FIGS. 9–11 which enjoys the same aforementioned advantages. In this embodiment, like reference numerals will be employed to designate elements which are substantially identical to those previously described. Again the superscript "'" designates the lower of two stringers.

In this second embodiment, rather than cutting the stringer ends to be horizontal upon assembly, the upper end 30A of the lower stringer 26' and the lower end 32A of the upper stringer 26 are cut as a projecting 'V' as shown in FIGS. 9–11, such that the end of upper stringer 26 has a vertical edge 80 and horizontal edge 82 and the end 30A of lower stringer 26' has a vertical edge 80' and horizontal edge 82'.

In this embodiment, the horizontally spaced slots and openings 34 and 36 have been eliminated and the slotted openings 38A have been retained which correspond to slots 38 which have been previously described, except that the slots 38A in this embodiment comprise a pair of rows of vertically spaced slots in the ends of each of the stringers and a pair of vertical ones of these slots 38A are now aligned with each other to attach both the adjacent stringer ends together and also function as mounting means for the vertical handrail post 54.

One advantage of this embodiment is that the structure shown in FIGS. 9–11 is strengthened by virtue of the more extensive overlap of the stringer ends with each other and also by the positioning of the vertical posts in overlying arrangement directly to the point of attachment and over its entire height. In addition, the number of slots and apertures is reduced, thereby strengthening the construction. Another advantage of the construction of this assembly is that the number of bolting steps and the bolts per se needed for assembly are further reduced because the same bolts used to attach the stringers together may also be utilized to completely attach the vertical posts 54 to the construction.

As in the previously described embodiment, the upper and lower stringers 26 and 26' may be shifted horizontally relative to each other to accommodate for wall curvatures which vary from the standard to which the stringers are dimensioned. For example, if the standard again is a 30-foot diameter of curvature, the adjacent stringers 26 and 26' will be in substantial alignment with each other when assembled as shown in FIG. 9.

If, however, the diameter of curvature is larger, such as 105 feet, the upper stringer 26 may be shifted horizontally to the left relative to the lower stringer 26' as shown in FIG. 10 to compensate for this differing degree of curvature.

Conversely, if the wall diameter of curvature is less than the standard 30 feet, e.g. 15 feet, the upper stringer 26 may be shifted horizontally to the right relative to the lower stringer 26' as shown in FIG. 11.

It will be understood that the preferred embodiments of the invention which have been described are merely illustrative of only a few of the principles of the present invention. Numerous modifications may be made by those skilled in the art without departing from the true spirit and scope of the present invention.

What we claim is:

1. A prefabricated curvilinear stairway construction for mounting to curvilinear walls of differing radii of curvature comprising:

first and second stringers of a given length each comprising longitudinally extending elongate members having inner and outer planar faces and which are substantially straight over their length, but which are bendable to assume a curvature over their length which is substantially concentric to the curvature of the wall to which the stairway construction is to be mounted;

a plurality of steps having inner and outer ends;

first mounting means mounting the outer ends of said steps to said inner planar face of said stringers at locations spaced from each other and the ends of said stringers along the length of said stringers; said bendable, substantially straight given length stringers bending substantially uniformly over their length such that, together with the outer ends of said steps which are mounted thereto, the planar faces of said stringers assume a curvature which is substantially concentric to the curvature of the curvilinear wall to which the stairway construction is to be mounted when the inner ends of said steps are positioned in spaced relationship to each other along a curve which is also substantially concentric to the curvature of the wall;

support means for supporting and fixing said inner ends of said steps in said spaced relationship along said last mentioned curve;

second mounting means for adjustably mounting either the inner or outer planar face of the upper end of one of said stringers to the other opposite planar face of the lower end of the other stringer, said mounting means permitting adjustment of the ends of the bent curved stringers relative to each other to compensate for the curvature of said stringers when mounted to each other for curvilinear walls of differing radii of curvature; and elongate reinforcing means formed integrally with said stringers and projecting from at least one of the planar faces of said stringers along at least one edge thereof, said reinforcing means along at least one edge of one of said stringers extending into overlying relationship with one of the planar faces of the other of said stringers, but away from the other of said stringers to permit the ends of said stringers to be adjusted and mounted in flush relationship to each other.

2. The stairway construction of claim 1, wherein said second mounting means mounts the ends of said stringers directly to each other.

3. The stairway construction of claim 1, wherein said support means comprise third and fourth bendable, but substantially straight stringers, and mounting means also mounting said inner ends of said steps in said spaced relationship to said third and fourth stringers, said third and fourth stringers being bent when so mounted to said inner ends of said steps to also assume a curvature which is substantially concentric to the curvature of the curvilinear wall to which the stairway construction is to be mounted.

4. The stairway construction of claim 3, wherein said third and fourth stringers also comprise longitudinally extending elongate members mountable one above the other, and mounting means mounting the upper end of one of said last mentioned stringers to the lower end of the other of said stringers.

5. The stairway construction of claim 3, wherein said first and second stringers are longer than said third and fourth stringers.

6. The stairway construction of claim 1 including said reinforcing means extending adjacent both of the longitudinal edges of the longitudinally extending stringer.

7. The stairway construction of claim 6 wherein second stringers are planar, and reinforcing means extend along upper and lower edges of said elongate first and second stringers and respectively project from the opposite planar faces of said stringers.

8. The stairway construction of claim 7, wherein said reinforcing means comprises a first flange which extends angularly from the plane of said stringers and a second flange which extends angularly from said first flange and substantially parallel to the plane of said stringers.

9. The stairway construction of claim 1 wherein said second mounting means comprise a plurality of spaced apertures adjacent the upper and lower ends of said first and second stringers respectively, at least some of said apertures in said first and second stringers overlying each other when said first and second stringers are mounted to each other.

10. The stairway construction of claim 9 wherein the upper and lower ends of said first and second stringers extend at an angle to the elongate axis of the elongate stringers and said apertures in each of said first and second stringers are spaced from each other along a substantially horizontal line.

11. The stairway construction of claim 10 wherein different ones of said apertures in said first and second stringers may be aligned with each other by moving said upper and lower ends of said stringers horizontally relative to each other to adjust for differing degrees of curvature of the wall.

12. The stairway construction of claim 11 wherein at least some of said apertures are slots.

13. The stairway construction of claim 9 wherein said apertures in each of said first and second stringers are spaced from each other in both the horizontal and vertical, and wherein different ones of said vertically spaced apertures in said first and second stringers may be aligned with each other by moving said upper and lower ends horizontally to adjust for differing degrees of curvature of the wall.

14. The stairway construction of claim 13 wherein at least some of said apertures are slots.

15. The stairway construction of claim 13 including post means having at least a pair of spaced apertures therein, said post means and the upper and lower ends of said first and second stringers all being mounted to each other through said apertures on said post means and at least a pair of said vertically spaced, aligned apertures.

16. The stairway construction of claim 6 including third and fourth stringers and mounting means mounts the inner ends of said step means to said third and fourth stringers, and mounting means for mounting the upper end of one of said third and fourth stringers directly to the lower end of the other stringer, said third and fourth stringers comprising elongate members mountable one above the other and which, when unmounted, are substantially straight over their length, but which bend over their length such that the curvature of said third and fourth stringers is substantially concentric to the curvature of the wall to which the stairway construction is to be mounted, wherein said first and second stringers are planar, and reinforcing means extending along upper and lower edges of said elongate first and second stringers and projecting from the plane of said stringers on opposite sides thereof, and wherein a plurality of said step means are mounted to each of said stringers between the end of said stringers.

17. The stairway construction of claim 16 wherein at least some of said apertures are slots and wherein different ones of said apertures in said first and second stringers may be aligned with each other by moving said upper and lower ends of said stringers horizontally relative to each other to adjust for differing degrees of curvature of the wall.

18. The stairway construction of claim 16 wherein at least some of said apertures are slots and wherein said apertures in each of said first and second stringers are spaced from each other in both the horizontal and vertical, and wherein different ones of said vertically spaced apertures in said first and second stringers may be aligned with each other by moving said upper and lower ends horizontally to adjust for differing degrees of curvature of the wall.

19. The stairway construction of claim 18 including post means, at least a pair of spaced apertures therein, said post means and the upper and lower ends of said first and second stringers all being mounted to each other through said apertures on said post means and at least a pair of said vertically spaced, aligned apertures.

20. The stairway construction of claim 16, wherein said reinforcing means comprises a first flange which extends angularly from the plane of said stringers and a second flange which extends angularly from said first flange and substantially parallel to the plane of said stringers.

21. The stairway construction of claim 16, wherein said first and second stringers are longer than said third and fourth stringers.

* * * * *

UNITED STATES PATENT AND TRADEMARK OFFICE

CERTIFICATE OF CORRECTION

PATENT NO. : 4,527,366

DATED : July 9, 1985

INVENTOR(S) : Paul S. Greene; David A. Greene

It is certified that error appears in the above-identified patent and that said Letters Patent are hereby corrected as shown below:

Col. 5, line 16: Before "and 40a", insert --40--

Signed and Sealed this

*Eighth* Day of *October 1985*

[SEAL]

*Attest:*

DONALD J. QUIGG

*Attesting Officer*

*Commissioner of Patents and Trademarks—Designate*